United States Patent [19]

Kurita et al.

[11] Patent Number: 4,624,816

[45] Date of Patent: Nov. 25, 1986

[54] PROCESS FOR THE MANUFACTURE OF POLYAMIDE FIBERS

[75] Inventors: Kazuo Kurita, Otsu; Hideaki Ishihara, Uji, both of Japan

[73] Assignee: Toyo Boseki Kabushiki Kaisha (Toyobo Co., Ltd.), Japan

[21] Appl. No.: 615,619

[22] Filed: May 31, 1984

Related U.S. Application Data

[62] Division of Ser. No. 415,773, Sep. 8, 1982, Pat. No. 4,504,545.

[30] Foreign Application Priority Data

Sep. 8, 1981 [JP] Japan ..... 56-142162

[51] Int. Cl.[4] ..... D01D 5/12

[52] U.S. Cl. ..... 264/210.7; 264/210.8; 264/290.5; 264/176.1

[58] Field of Search ..... 264/210.7, 210.8, 290.5, 264/176 F; 428/364

[56] References Cited

U.S. PATENT DOCUMENTS

| | | | |
|---|---|---|---|
| 3,091,015 | 5/1963 | Zimmerman | 264/289.3 |
| 3,522,342 | 7/1970 | Nungesser et al. | 264/290.5 |
| 3,905,076 | 9/1975 | Harris | 264/290.5 |
| 4,009,511 | 3/1977 | Gauntt | 264/290.5 |
| 4,042,662 | 8/1977 | Corbin, Jr. et al. | 264/290.5 |
| 4,229,404 | 10/1980 | Hatcher et al. | 264/290.5 |
| 4,338,277 | 7/1982 | Saito et al. | 264/290.5 |
| 4,461,740 | 7/1984 | Koschinek et al. | 264/290.5 |
| 4,485,063 | 11/1984 | Good | 264/290.5 |

FOREIGN PATENT DOCUMENTS

| | | | |
|---|---|---|---|
| 2855779 | 6/1979 | Fed. Rep. of Germany | 264/210.8 |
| 45-26572 | of 0000 | Japan . | |
| 35-05113 | 5/1960 | Japan . | |
| 45-06284 | 3/1970 | Japan | 264/210.8 |
| 45-36336 | 11/1970 | Japan | 264/210.8 |
| 48-12085 | 4/1973 | Japan . | |
| 48-39369 | 11/1973 | Japan . | |
| 51-02528 | 1/1976 | Japan . | |
| 52-40620 | 3/1977 | Japan | 264/210.8 |
| 53-38712 | 4/1978 | Japan | 246/210.8 |
| 1224255 | 3/1971 | United Kingdom | 264/210.8 |

*Primary Examiner*—Donald Czaja
*Assistant Examiner*—Hubert C. Lorin
*Attorney, Agent, or Firm*—Jones, Tullar & Cooper

[57] ABSTRACT

A process for the manufacture of polyamide fibers including melt spinning a polyamide having a relative viscosity of not less than 3.50 under conditions satisfying the following relationships:

$Q/D^3 \leqq 982$ g/sec.cm$^3$ $D^2.Vw/Q \leqq 12.8$ cm$^3$/g $T_{20} \geqq 100°$ C.

$\Delta n$ of unstretched filaments $\leqq 0.017$

The resultant filaments are then subjected to cooling, stretching and heat treatment resulting in fibers with a break strength of not less than 11.0 g/d, a break strength $\times$ (break elongation(%))$^{1/2}$ of not less than 46.0 and a monofilament denier of not more than 60 d.

13 Claims, 4 Drawing Figures

PROCESS FOR THE MANUFACTURE OF POLYAMIDE FIBERS

CROSS-REFERENCE TO RELATED APPLICATION

This application is a divisional application of application Ser. No. 415,773, filed 9/8/82 now U.S. Pat. No. 4,504,545.

The present invention relates to polyamide fibers having improved properties and their production. More particularly, it relates to polyamide fibers having high strength and excellent resistance to fatigue and being useful for reinforcement of rubber, and their production.

Among numerous and various uses of polyamide fibers, there is included the use as reinforcing materials for rubber products such as tire cords. For manufacture of polyamide fibers directed to such use, there are proposed a method wherein an unstretched polyamide filament is stretched in multi-steps (Japanese Patent Publn. No. 5113/60), a method wherein a polyamide having a high degree of polymerization is used for production of fibers (Japanese Patent Publn. No. 26572/70), etc. Adoption of these methods can more or less improve the strength of polyamide fibers or prevent the decrease of the strength of the rubber products reinforced with such polyamide fibers on the vulcanization at high temperatures. However, the elongation becomes smaller so that the toughness is not improved. Thus, the break strength and the break elongation are insufficient for the use as the reinforcing materials in tire cords.

Also, there are proposed some methods for manufacture of polyamide fibers of high strength by the use of a polyamide having a high relative viscosity (Japanese Patent Publns. Nos. 12085/73, 2528/76 and 39369/73). In these methods, however, the upper limit of the relative viscosity is restricted; in case of polycaprolactam, the relative viscosity is required to be from 3.0 to 4.2 in Japanese Patent Publn. No. 12085/73, from 3.32 to 4.01 in Japanese Patent Publn. No. 2528/76 and from 3.00 to 4.50 in Japanese Patent Publn. No. 39369/73. This is because, in case of the relative viscosity of a polyamide being 3.5 or more, particularly 4.0 or more, the shearing viscosity and the stretching viscosity become remarkably high, and stable spinning is made extremely difficult. Further, a sufficiently high stretch ratio such as 4.50 or more can be hardly achieved.

As a result of an extensive study, it has now been found that a polyamide having a relative viscosity of 3.5 or more can be readily spun under certain specific conditions. It has also been found that the resulting filaments can be stretched with a sufficiently high stretch ratio. It has further been found that the resultant fibers have excellent physical properties such as high break strength, high knot strength, high break elongation and high toughness.

In this connection, it may be noted that the polyamide fibers of the invention have novel structural characteristics as not observed in conventional polyamide fibers. Namely, they are different from conventional fibers in distribution of the refractive index in section. It is particularly notable that they have a micro-structure wherein the fiber long-period spacing value (hereinafter referred to as "the fiber long period") by small angle X-ray scattering is longer in comparison with that of conventional polyamide fibers. Such structural characteristics are especially remarkable when the fibers are made of a polyamide comprising polycapramide or polyhexamethylene adipamide as the major component, particularly a polyamide comprising polycapramide in a content of not less than 75% by weight.

According to the present invention, there is provided a process for preparing polyamide fibers which comprises melt spinning a polyamide having a relative viscosity of not less than 3.50 under the following conditions:

$$Q/D^3 \leqq 982 \text{ g/sec.cm}^3 \quad (1)$$

$$D^2 \cdot Vw/Q \leqq 12.8 \text{ cm}^3/\text{g} \quad (2)$$

$$T_{20} \geqq 100° \text{ C.} \quad (3)$$

$$\Delta n \text{ of unstretched filament} \leqq 0.017 \quad (4)$$

(wherein Q is the discharge amount per each nozzle hole (g/sec); D is the diameter of nozzle hole (cmϕ), Vw is the take up speed of spun filaments (cm/sec), $T_{20}$ is the atmospheric temperature as measured 5 mm apart from the spun filaments at the position of 20 mm from the nozzle face towards the discharge of the filaments (°C.) and Δn of the unstretched filaments is the value determined after allowed to stand at a temperature of 30° C. under a relative humidity of 80% for a period of 24 hours); subjecting the resultant filaments to cool, followed by application of a lubricant thereto; and subjecting the resulting filaments to stretching and heat treatment.

The polyamide fibers obtained by the above process are characteristic in being made of a polyamide and having a relative viscosity of not less than 3.50, an index of birefringence (Δn) of not less than $50\times10^{-3}$ and a toughness (=break strength (g/d)×(break elongation (%))$^{1/2}$) of not less than 46.0, the index of birefringence in section satisfying the following relationship:

$$\Delta n_A - \Delta n_B = 0.5\times10^{-3} \quad (5)$$

(wherein $\Delta n_A$ is the index of birefringence of fiber at the position of r/R=0.9, $\Delta n_B$ is the index of birefringence of fiber at the position of r/R=0.0, R is the radius of the section of fiber and r is the distance from the central axis of the section of fiber).

Polyamides to be used for manufacture of the fibers of this invention are those having a relative viscosity of not less than 3.5, preferably of not less than 4.0, when measured on a 96% sulfuric acid solution having a polymer concentration of 10 mg/ml at 20° C. Their specific examples include polycaprolactam, polyhexamethylene adipamide, polyhexamethylene sebacamide, etc. Copolymers of the monomeric components in said specific polyamides as well as condensation products of diamines such as 1,4-cyclohexane bis(methylamine) and linear aliphatic dicarboxylic acids are also usable. When the relative viscosity is less than 3.5, it is hardly possible to obtain fibers having the distribution of the refractive index in section satisfying the relationship of the formula (5). Further, the fibers resulting from a polyamide having such relative viscosity are not high in break strength and have usually about 10 g/d at the most. Still, polyamides may be incorporated with conventional additives and/or modifiers insofar as the desired properties are not deteriorated.

Besides, higher strength characteristics can be achieved when the fiber long period by small angle X-ray scattering is 100 Å or more. Further, the structure satisfying the relationship of the formula (5) is apt to be formed easily and a higher knot strength is readily obtainable when the monofilament denier is not more than 60 d. Furthermore, the index of birefringence of unstretched filaments affords a very great influence on the entire stretch ratio. In order to assure an entire stretch ratio of 4.50 or more, the Δn value of unstretched filaments is preferred to be set below 0.017 (measured after allowed to stand at a temperature of 30° C. under a relative humidity of 80% for a period of 24 hours).

For manufacture of polyamide fibers according to the present invention, it is essential that the spinning of a polyamide is effected under the condition satisfying the relationship of the formula (1). When this relationship is not satisfied, the discharge behavior of the polyamide at the outlet of the nozzle orifice on spinning becomes unstabilized so that breakage of filaments on spinning or stretching frequently occurs. Even if spun and stretched well, the resultant fibers are inferior in strength. It is also essential that the spinning is effected under the condition satisfying the relationship of the formula (2). When the relationship is not satisfied, the tension on spinning becomes high so that the running of the spun filaments is unstabilized to produce cutting. Even if cutting is not produced, the stretch ratio at stretching and heat treatment steps is lowered, and a satisfactory strength can not be attained. Further, it is essential to carry out the spinning satisfying the relationship of the formula (3). When this relationship is not satisfied, the Δn value of unstretched filaments is apt to become more than 0.017, and the relationship of the formula (4) is made unsatisfied. As a result, a high stretch ratio can not be retained, and fibers of high strength are hardly obtainable.

Preferably, the spinning may be carried out under the conditions satisfying the following relationships:

$$Q/L^3 \leqq 500 \text{ g/sec.cm}^3 \quad (1')$$

$$D^2 \cdot Vw/Q \leqq 5.0 \text{ cm}^3/\text{g} \quad (2')$$

$$T_{300} \geqq 100° \text{ C.} \quad (3')$$

$$\Delta n \text{ of unstretched filament } \leqq 0.013 \quad (4')$$

wherein $T_{300}$ is the atmospheric temperature as measured 5 mm apart from the filaments at the position of 300 mm from the nozzle surface towards the discharge of filaments. The above conditions are quite effective in stabilization of the spinning of a polyamide having a relative viscosity of not less than 4.0.

Maintenance of the said atmospheric temperature is effective in lowering the n value of the polyamide having a relative viscosity of 4.0 or more, and such temperature is desired to be not lower than 100° C. Further, by adjustment of the nozzle hole diameter to 0.4 mmϕ or less, the productivity is much increased.

Except the said conditions are chosen, the spinning may be carried out according to a melt spinning procedure as conventionally adopted.

The resulting filaments are subjected to stretching in multi-stages. Stretching may be carried out, for instance, by prestretching the filaments at a stretch ratio of not more than 1.10 and stretching the resultant filaments at the first stage by the use of a hot roller or a room temperature roller. Alternatively, the filaments may be stretched at the first stage with pressurized steam of 200° C. or higher and then at the second stage while heating at a temperature of 100° to 200° C. In any event, at least 50% of the entire or total stretch ratio may be accomplished at the first stage stretching for stabilization of the stretching behavior. In general, a higher entire stretch ratio of not less than 4.5, preferably of not less than 5.0, is favorable. The temperature at the first stage stretching is usually kept at a temperature below 100° C., when the stretching is effected with a roller. Stretching at a temperature of more than 100° C. makes the filaments on the roller unstabilized, and the entire stretch ratio is lowered. When pressurized steam of high temperature is used at the first stage stretching, the distance between the filaments and the steam ejecting head is usually not more than 50 mm, preferably not more than 20 mm, and the steam temperature at the steam ejecting head may be kept at a temperature of 200° to 600° C. In case of the temperature being lower than 200° C., the stretching speed can not be raised sufficiently so that the stretching point is not fixed. In case of the temperature being higher than 600° C., the filaments are apt to be melt cut and unstabilized. The distance of more than 50 mm between the filaments and the steam ejecting head results in the remarkable depression of the filaments at the stretching point, and the fixation of the stretching point is difficult unless the running of the filaments is made with an abnormally low speed. For obtaining polyamide fibers excellent in strength, the filament contact portions at the stretching and heat treatment steps are preferred to be as little as possible. For instance, at the second stage stretching and heat treatment, the use of a heater of non-contact type is effective.

For accomplishment of the stretching with a high stretch ratio without producing any void or defect in the fibers, three stage or four stage stretching conditions at the 2nd and 3rd stages are important. When the stretching at the 2nd and 3rd stages is carried out by the use of a conventional apparatus such as a hot roller, a hot pin or a hot plate, the temperature for heat treatment at the 3rd stage is favored to be higher than that at the 2nd stage. For instance, the 2nd stage stretching and the 3rd stage stretching may be respectively effected at temperatures of 100° to 200° C. and of 160° to 220° C. Alternatively, stretching with pressurized steam of high temperature may be adopted at the 2nd stage stretching. In the four stage stretching, the filaments are subjected to stretching with pressurized steam of high temperature at the 3rd stage after stretching with a conventional heating means such as a hot roller, a hot pin or a hot plate at the 2nd stage and then to heat treatment at the 4th stage.

The thus obtained fibers of the invention are characteristic in having excellent physical properties such as high break strength of not less than 11.0 g/d, high knot strength of not less than 8.0 g/d, high break elongation of not less than 15% and high toughness of not less than 46.0. These favorable properties are closely correlated to the micro-structure of the fibers, which can never be realized by conventional procedures.

The fibers of the invention may be employed for various uses, particularly as reinforcing materials for rubber products. When employed as rubber reinforcing materials, they are normally used in a multi-filament state. However, this is not limitative, and the fibers may be used in any other state such as robing yarn, staple fiber or chopped strand. The fibers of the invention are suitably employed as tire cords, particularly carcass cords in radial structure tires for heavy weight vehicles and as rubber reinforcing cords in V belts, flat belts, toothed belts, etc.

The methods for measurement of various parameters as hereinabove and hereinafter referred to are explained below.

Measurement of relative viscosity (RV):

A polyamide was dissolved in conc. sulfuric acid (96.3±0.1% by weight) to make a concentration of 10 mg/ml. The falling time of 20 ml of the resulting solution ($T_1$; second) was measured at a temperature of 20°±0.05° C. by the use of an Ostwald viscosimeter of 6 to 7 seconds in water falling time. Using the same viscosimeter as above, the falling time of conc. sulfuric acid as used above ($T_0$; second) was also measured. The relative viscosity (RV) was calculated according to the following equation:

$$RV = T_1/T_0$$

Measurement of index of birefringence (Δn):

Measurement was effected by the use of a Nikon polarization microscope (POH type) with a compensator manufactured by Reiz. As the light source, an apparatus for spectrum light source (Na) manufactured by Toshiba was used. A specimen cut at an angle of 45° to the fiber axis of 5 to 6 cm long was placed on a slide glass. The slide glass was placed on a rotatable stand, and the stand was rotated so as to make an angle of 45° between the specimen and the polarizer. An analyzer was inserted to make a dark field, the compensator was adjusted to 30, and the number of fringe patterns (n) was counted. The compensator was rotated clockwise and the scale (a) at which the specimen first became darkest was read. Then, the compensator was rotated counterclockwise, and the scale (b) at which the specimen first became darkest was read. The compensator was returned to 30, the analyzer was taken off, and the diameter of the specimen (d) was measured. The index of birefringence (Δn) was calculated according to the following equation (average of 20 measured values):

$$\Delta n = \Gamma/d(\Gamma = n\lambda_o + \epsilon)$$

$$\lambda_o = 589.3 m\mu$$

wherein ε is obtained from C/10,000 and i in the Reiz's explanation sheet of the compensator, i being a−b (i.e. the difference in readings of the compensator).

Measurement of the distribution of Δn in section:

From the refractive index at the center (N⊥, O and N||, O) and the refractive index at the outer layer (N⊥, 0.9 and N||, 0.9) measured by the use of an interference-polarization microscope, the specific molecular orientation of the fiber of the invention is made clear, and the relationship between the fiber and its excellent strength can be shown. According to the interference band method using an interference-polarization microscope manufactured by Jena, the distribution of the average refractive index observed from the side of the fiber can be measured. This method is applicable to the fiber having a circular section. The refractive index of the fiber can be characterized by the refractive index (N||) to the polarization vibrating in parallel to the fiber axis and the refractive index (N⊥) to the polarization vibrating vertically to the fiber axis. Measurements as hereinafter explained are all carried out with the refractive indexes (N|| and N⊥) obtained by the use of a xenon lamp as the light source and a green color beam of an interference filter wave length of 544 m under polarization.

Illustrating the measurement of N|| as well as N||, 0 and N||, 0.9 obtainable from N||, the fiber is immersed in a sealing agent having a refractive index ($N_E$) which will produce a gap of the interference band within a wave length of 0.2 to 1 and being inert to the fiber by the use of a slide glass and a cover glass which are optically flat. The refractive index of the sealing agent ($N_E$) indicates the value measured by the use of an Abbe refractometer with a green color beam (wave length, λ=544 mμ) at 20° C. The sealing agent may be, for instance, a mixture of liquid paraffin and α-bromonaphthalene, having a refractive index of 1.48 to 1.65. A monofilament of the fiber is immersed in the sealing agent, and the pattern of the interference band is photographed. The resulting photograph is expanded in 1,000 to 2,000 times and subjected to analysis.

Figure 1A:
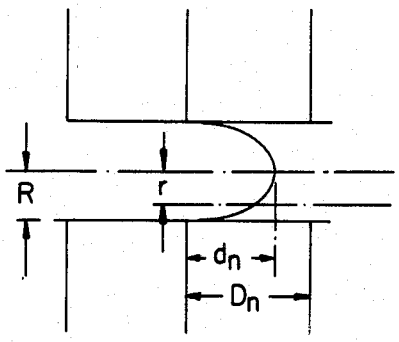
FIG. 1(A) shows parallel interference bands, the gap produced by the specimen of FIG. 1(B), and the light path difference in the gap.
Figure 1B:
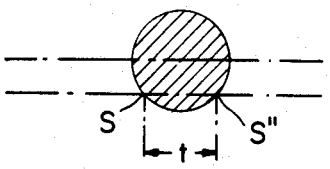
FIG. 1(B) shows the fiber in cross section which produces the gap of FIG. 1(A).

As shown in FIG. 1 of the accompanying drawings, the light path difference (L) can be represented by the following equation:

$$L = \frac{d_n}{D_n}\lambda = (N\| - N_E)t$$

wherein $N_E$ is the refractive index of the sealing agent, N is the average refractive index between S' and S'' of the fiber, t is the thickness between S' and S'', λ is the wave length of the used beam, Dn is the distance of the paralleled interference bands of the background (corresponding to 1λ) and $d_n$ is the gap of the interference band due to the fiber.

The pattern of interference bands as shown in FIG. 1 is evaluated using two kinds of the sealing agents having the following refractive indexes ($N_1$, $N_2$):

$N_s \leqq N_1$ $N_s \geqq N_2$ wherein $N_s$ is the refractive index of the specimen. Thus, the light path differences ($L_1$, $L_2$) in the case of using the sealing agents having the refractive indexes $N_1$, $N_2$ are representable by the following equations:

$$L_1 = \frac{d_1}{D_1}\lambda = (N\| - N_1)t$$

$$L_2 = \frac{d_2}{D_2}\lambda = (N\| - N_2)t$$

$$N\| = \frac{L_1N_2 - L_2N_1}{L_1 - L_2}$$

Accordingly, the distribution of the average refractive index (N||) of the fiber in various positions from the center to outer layer of the fiber can be calculated from the light path difference at those positions according to the above equation. The thickness (t) may be calculated on the assumption that the fiber as obtained has a circular section. Due to any variation of the conditions on the manufacture or any accident after the manufacture, the fiber may have any non-circular section. In order to avoid the inconvenience caused by such section, measurement should be made for the parts where the gap of the interference band is symmetric to the fiber axis. Measurement is effected with intervals of 0.1 R between 0 and 0.9 R, R being the radius of the fiber, and the average refractive index at each position is obtained.

Likewise, the distribution of N⊥ is obtainable.

Therefore, the distribution of the index of birefringence may be calculated according to the following equation:

$$\Delta n(r/R)=N\|,\ r/R-N\perp,\ r/R$$

The value Δn(r/R) indicates an average on at least three filaments, preferably 5 to 10 filaments.

Measurement of strength-elongation characteristics of fiber:

Using a tensilon tester manufactured by Toyo-Baldwin, the S—S curve of a monofilament was measured under the conditions of a specimen length (gauge length) of 100 mm, an elongation speed of 100%/min, a recording speed of 500 mm/min and an initial load of 1/30 g/d, and the break strength (g/d), the break elongation (%) and the Young's modulus (g/d) were calculated therefrom.

Measurement of knot strength of fibers:

A monofilament fiber of 50 mm loop was set on a tensilon tester manufactured by Toyo-Baldwin, and the S—S curve was measured under the conditions of a gauge length of 50 mm, an elongation speed of 100%/min and a recording speed of 500 mm/min, from which the knot break strength (g/d) and the knot break elongation (%) were calculated. The obtained value is an average on 10 to 20 filaments.

Figure 2A:
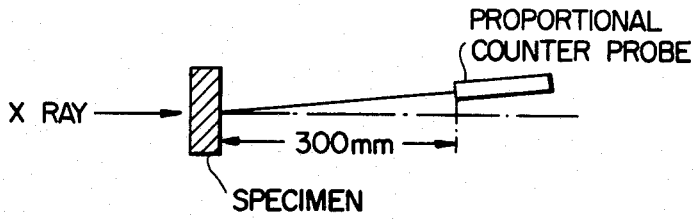
Figure 2B:
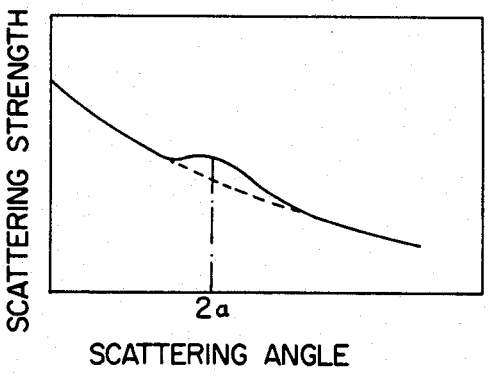

Measurement of fiber long period by small angle X-ray diffraction:

FIG. 2(A) illustrates X-rays being applied to a specimen to measure the small angle X-ray scattering pattern by a diffractometer;

FIG. 2(B) shows a plot of scattering strength v. scattering angle which indicates the diffraction strength.

Measurement of the small angle X-ray scattering pattern was effected by the use of an X-ray generator (Model RU-3H) manufactured by Rigaku Denki. The conditions on measurement were as follows: tube voltage, 45 KV; tube current, 70 mA; copper target; CuKα monochromatized with a nickel filter (λx=1.5418 Å). A specimen was provided on a sample holder so as to keep the monofilaments in parallel. A suitable thickness of the specimen was 0.5 to 1.0 mm. X-rays were applied to the fibers vertically to the fiber axis arranged in parallel, and a diffractometer provided with a proportional counter probe (SPC 20) manufactured by Rigaku Denki at a distance of 300 mm from the specimen was rotated with an angle rotation speed of 2 seconds/min. The diffraction strength curve was thus measured. The small angle scattering angle (2α) was read off from the peak position or the shoulder position in the diffraction strength curve, and the fiber long period was calculated according to the following equation (cf. FIGS. 2(A) and (B)):

$$d = \frac{\lambda x}{2\ \mathrm{Sin}\alpha}$$

$$\lambda x = 1.5418\ (\text{Å})$$

The present invention will be illustrated more in detail by Examples and Comparative Examples wherein part(s) and % are by weight unless otherwise indicated.

EXAMPLES 1 TO 9 AND COMPARATIVE EXAMPLES 1 AND 2

A polycapramide having a relative viscosity as shown in Table 1 was spun under the conditions as shown in Table 1 to make filaments, of which the index of birefringence (Δn) (measured after allowed to stand at 30° C. under a relative humidity of 80% for 24 hours) and the relative viscosity (RV) are shown in Table 1. The heating zone below the nozzle was positioned between the nozzle and the cooling zone. On spinning, an appropriate amount of a spinning oil was applied onto the surfaces of the filaments before the taking up of them. The obtained filaments were subjected to stretching and heat treatment under the conditions as shown in Table 2 to give the stretched fibers having the properties as shown in Table 3.

TABLE 1

| | Spinning condition | | | | | | | | | | |
|---|---|---|---|---|---|---|---|---|---|---|---|
| | Example | | | | | | | | | Comparative | |
| | 1 | 2 | 3 | 4 | 5 | 6 | 7 | 8 | 9 | 1 | 2 |
| Relative viscosity of polycapramide | 4.1 | 4.1 | 4.1 | 4.1 | 4.1 | 4.1 | 4.1 | 4.8 | 4.8 | 3.3 | 4.1 |
| Spinning temperature (°C.) | 280 | 280 | 280 | 280 | 280 | 280 | 280 | 290 | 290 | 260 | 280 |
| Diameter of nozzle hole (mmϕ) | 0.3 | 0.3 | 0.3 | 0.25 | 0.25 | 0.3 | 0.3 | 0.25 | 0.25 | 0.3 | 0.3 |
| Length of nozzle hole (mm) | 0.6 | 0.6 | 0.6 | 0.50 | 0.50 | 0.6 | 0.6 | 0.50 | 0.50 | 0.6 | 0.6 |
| Discharge amount of each hole (g/min) | 0.3 | 0.3 | 0.3 | 0.25 | 0.25 | 0.3 | 0.3 | 0.2 | 0.2 | 1 | 0.3 |
| Length of heating zone below nozzle (mm) | 300 | 300 | 300 | 450 | 450 | 300 | 300 | 600 | 600 | — | 300 |
| Temperature of heating zone below nozzle (°C.) | 200 | 200 | 200 | 220 | 220 | 200 | 200 | 220 | 220 | — | 60 |
| Speed of cooling air (m/sec) | 0.4 | 0.4 | 0.4 | 0.4 | 0.4 | 0.4 | 0.4 | 0.4 | 0.4 | 0.4 | 0.4 |
| Temperature of cooling air (°C.) | 20 | 20 | 20 | 20 | 20 | 20 | 20 | 20 | 20 | 20 | 20 |
| Length of cooling zone (mm) | 600 | 600 | 600 | 600 | 600 | 600 | 600 | 600 | 600 | 600 | 600 |
| Take up speed (m/min) | 20 | 20 | 20 | 20 | 20 | 20 | 20 | 10 | 10 | 280 | 20 |

TABLE 1-continued

| | Spinning condition | | | | | | | | | | |
|---|---|---|---|---|---|---|---|---|---|---|---|
| | Example | | | | | | | | | Comparative | |
| | 1 | 2 | 3 | 4 | 5 | 6 | 7 | 8 | 9 | 1 | 2 |
| $T_{20}$ (°C.) | 210 | 210 | 210 | 230 | 230 | 210 | 210 | 230 | 230 | 120 | 60 |
| $T_{300}$ (°C.) | 200 | 200 | 200 | 220 | 220 | 200 | 200 | 220 | 220 | 20 | 51 |
| $Q/D^3$ (g/sec · $cm^3$) | 185 | 185 | 185 | 267 | 267 | 185 | 185 | 213.3 | 213.3 | 617 | 185 |
| $D^2 \cdot Vw/Q$ ($cm^3$/g) | 6.0 | 6.0 | 6.0 | 5.0 | 5.0 | 6.0 | 6.0 | 3.1 | 3.1 | 25.2 | 5.0 |
| Index of birefringence of unstretched filament (Δn) | $7.9 \times 10^{-3}$ | $7.9 \times 10^{-3}$ | $7.9 \times 10^{-3}$ | $10.1 \times 10^{-3}$ | $10.1 \times 10^{-3}$ | $7.9 \times 10^{-3}$ | $7.9 \times 10^{-3}$ | $9.2 \times 10^{-3}$ | $9.2 \times 10^{-3}$ | $15 \times 10^{-3}$ | $18 \times 10^{-3}$ |
| Relative viscosity of unstretched filament (RV) | 4.0 | 4.0 | 4.0 | 3.95 | 3.95 | 4.0 | 4.0 | 4.4 | 4.4 | 3.3 | 4.0 |

TABLE 2

| | Stretching condition | | | | | | | | | | |
|---|---|---|---|---|---|---|---|---|---|---|---|
| | Example | | | | | | | | | Comparative | |
| | 1 | 2 | 3 | 4 | 5 | 6 | 7 | 8 | 9 | 1 | 2 |
| 1st Feed roller for unstretched filament | | | | | | | | | | | |
| Temperature (°C.) | 20 | 20 | 20 | 20 | 20 | 20 | 20 | 20 | 20 | 20 | 20 |
| Speed (m/sec) | 13.7 | 27.0 | 13.7 | 13.7 | 13.7 | 13.8 | 13.8 | 27.0 | 13.7 | 27.0 | 13.7 |
| Preliminary elongation (time) | 1.02 | 1.01 | 1.02 | 1.02 | 1.02 | 1.04 | 1.04 | 1.02 | 1.02 | 1.01 | 1.05 |
| 2nd Feed roller for unstretched filament | | | | | | | | | | | |
| Temperature (°C.) | 20 | 20 | 20 | 20 | 20 | 20 | 50 | 20 | 20 | 60 | 20 |
| Speed (m/sec) | 14.0 | 27.3 | 14.0 | 14.0 | 14.0 | 14.3 | 14.3 | 27.5 | 14.0 | 27.3 | 14.4 |
| Hot plate | | | | | | | | | | | |
| Temperature (°C.) | — | — | — | — | — | — | — | — | — | — | — |
| Length (cm) | | | | | | | | | | | |
| Pressurized steam* | | | | | | | | | | | |
| Temperature (°C.) | — | 250 | — | — | — | — | — | 274 | — | — | — |
| Pressure (kg/$cm^2$) | | 5 | | | | | | 4.6 | | | |
| 1st Stretch roller | | | | | | | | | | | |
| Temperature (°C.) | 20 | 20 | 20 | 20 | 20 | 20 | 20 | 20 | 20 | 20 | 20 |
| Speed (m/sec) | 43.8 | 132 | 43.7 | 37.9 | 37.9 | 43.9 | 43.9 | 98.5 | 44.6 | 87.2 | 44.6 |
| Stretch ratio (time) | 3.1 | 4.8 | 3.1 | 2.7 | 2.7 | 3.1 | 3.1 | 3.6 | 3.2 | 3.2 | 3.1 |
| Hot plate** | C | C | N | N | N | | | N | N | C | C |
| Temperature (°C.) | 180 | 190 | 185 | 185 | 175 | — | — | 180 | 185 | 185 | 165 |
| Length (cm) | 60 | 90 | 90 | 90 | 90 | | | 90 | 90 | 30 | 30 |
| Pressurized steam | | | | | | | | | | | |
| Temperature (°C.) | — | — | — | — | — | 235 | 235 | — | — | — | — |
| Pressure (kg/$cm^2$) | | | | | | 5.0 | 5.0 | | | | |
| 2nd Stretch roller | | | | | | | | | | | |
| Temperature (°C.) | 20 | 20 | 20 | 20 | 20 | 20 | 20 | 20 | 20 | 20 | 20 |
| Speed (m/sec) | 68.8 | 138.6 | 74.1 | 66.0 | 64.0 | 61.9 | 61.9 | 140 | 70 | 137.7 | 62.5 |
| Stretch ratio (time) | 1.6 | 1.1 | 1.7 | 4.8 | 4.7 | 1.4 | 1.4 | 1.4 | 1.6 | 1.6 | 1.4 |
| Hot Plate | | | | | | N | N | | | | |
| Temperature (°C.) | — | — | — | — | — | 185 | 185 | | | | |
| Length (cm) | | | | | | 90 | 90 | | | | |
| Pressurized steam | | | | | | | | | | | |
| Temperature (°C.) | 250 | — | — | — | — | — | — | — | — | — | — |
| Pressure (kg/$cm^2$) | 5 | | | | | | | | | | |
| 3rd Stretch roller | | | | | | | | | | | |
| Temperature (°C.) | 20 | — | — | — | — | 20 | 20 | — | — | — | — |
| Speed (m/sec) | 74 | | | | | 79.8 | 79.8 | | | | |
| Stretch ratio (time) | 1.1 | | | | | 1.3 | 1.3 | | | | |
| Hot plate | C | | | | | | | | | | |
| Temperature (°C.) | 200 | — | — | — | — | — | — | — | — | — | — |
| Length (cm) | 90 | | | | | | | | | | |
| 4th Stretch roller | | | | | | | | | | | |
| Temperature (°C.) | 20 | — | — | — | — | — | — | — | — | — | — |
| Speed (m/sec) | 74.2 | | | | | | | | | | |
| Stretch ratio (time) | 1.0 | | | | | | | | | | |
| Entire Stretch ratio (time) | 5.4 | 5.1 | 5.4 | 4.8 | 4.7 | 5.8 | 5.8 | 5.2 | 5.1 | 5.1 | 4.6 |
| Remarks | 4-step stretch-ing | 2-step stretching | | | | 3-step stretching | | 2-step stretching | | | |

Note:
*Distance between filaments and nozzle head, 5 mm.
**C = contact with hot plate; N = non-contact with hot plate

TABLE 3

| | Properties of stretched fibers | | | | | | | | | | |
|---|---|---|---|---|---|---|---|---|---|---|---|
| | Example | | | | | | | | | Comparative | |
| | 1 | 2 | 3 | 4 | 5 | 6 | 7 | 8 | 9 | 1 | 2 |
| Denier (d) | 25.0 | 26.3 | 28.5 | 21.2 | 22.7 | 27.0 | 27.1 | 29.4 | 31.8 | 6.3 | 30.0 |
| Breaking strength (g/d) | 12.1 | 11.3 | 12.0 | 13.8 | 11.6 | 11.35 | 11.31 | 13.8 | 13.4 | 9.4 | 9.3 |
| Tensile elongation at break (%) | 25.0 | 30.0 | 20.6 | 25.2 | 23.6 | 22.6 | 19.8 | 23.0 | 21.3 | 22.5 | 23.6 |
| Break strength × (Break elongation)$^{\frac{1}{2}}$ (g · %$^{\frac{1}{2}}$/d) | 60.5 | 61.9 | 54.5 | 69.3 | 56.4 | 54.0 | 50.3 | 66.2 | 61.8 | 44.6 | 45.2 |
| Knot strength (g/d) | 8.5 | 8.7 | 8.5 | 8.9 | 8.6 | 8.7 | 8.5 | 8.8 | 8.6 | 8.4 | 6.5 |
| $\Delta n$ ($\times 10^{-3}$) | 58.2 | 57.6 | 53.0 | 53.5 | 52.7 | 58.1 | 58.3 | 57.3 | 57.5 | 57.6 | 58.1 |
| $\Delta n_A$-$\Delta n_B$ ($\times 10^{-3}$) | 0.8 | 0.7 | 0.7 | 0.9 | 0.6 | 0.7 | 0.8 | 1.0 | 0.9 | 0.0 | 0.0 |
| Fiber long period (Å) | 107 | 105 | 107 | 112 | 108 | 107 | 107 | 115 | 112 | 98 | 107 |

As understood from Tables 1 to 3, Examples 1 to 9 satisfying the conditions required for spinning gave fibers having excellent properties. In Comparative Example 1, the relative viscosity of the polycapramide is low and the average molecular chain length constituting the fibers is short so that a sufficient break strength is not obtainable. In Comparative Example 2, the $T_{20}$ value is too low, and the $\Delta n$ value of the unstretched filaments exceeds the desired one. Thus, the elongation is lowered, and the break strength and the knot strength are not satisfactory.

What is claimed is:

1. A process for the manufacture of polyamide fibers which comprises the steps of: melt spinning a polyamide having a relative viscosity of not less than 3.50 under the conditions satisfying the following relationships:

$Q/D^3 \leqq 982$ g/sec.cm$^3$ $D^2.Vw/Q \leqq 12.8$ cm$^3$/g $T_{20} \geqq 100°$ C.

$\Delta n$ of unstretched filament $\leqq 0.017$ (wherein Q is the discharge amount per each nozzle hole (g/sec); D is the diameter of each nozzle hole (cm$\phi$), Vw is the take up speed of spun filaments (cm/sec) $T_{20}$ is the atmospheric temperature at a distance of 5 mm from the spun filaments and at a distance of 20 mm from the nozzle face towards the discharge of the filaments (°C.) and $\Delta n$ of the unstretched filaments is the value determined after the filaments are allowed to stand at a temperature of 30° C. under a relative humidity of 80% for a period of 24 hours);

subjecting the resultant filaments to cooling;

further subjecting the resulting filaments to stretching and heat treatment; and providing said fibers with a break strength of not less than 11.0 g/d, said break strength (g/d)×(the break elongation (%))$^{\frac{1}{2}}$ being not less than 46.0, and a monofilament denier of not more than 60d.

2. The process according to claim 1, wherein after cooling the filaments are taken up and then subjected to said stretching and heat treatment.

3. The process according to claim 1, wherein the polyamide fiber comprises polycapramide in an amount of not less than 75% by weight on the basis of the weight of the polyamide fiber.

4. The process according to claim 1, wherein the spinning is carried out at an atmospheric temperature of not lower than 100° C., the temperature being measured at a distance of 5 mm from the filaments and at a distance of 300 mm from the nozzle surface towards the discharge of the filament.

5. The process according to claim 1, wherein the polyamide has a relative viscosity of not less than 4.0 and the spinning is carried out under the conditions satisfying the following relationships:

$Q/D^3 \leqq 500$ g/sec.cm$^3$ $D^2.Vw/Q \leqq 5.0$ cm$^3$/g $T_{300} \geqq 100°$ C.

$\Delta n$ of unstretched filament $\leqq 0.013$ (wherein $T_{300}$ is the atmospheric temperature at a distance of 5 mm from the spun filaments and at a distance of 300 mm from the nozzle surface towards the discharge of filaments (°C.)).

6. The process according to claim 1, wherein the stretching and heat treatment is carried out by prestretching the filaments between a 1st feed roller and a 2nd feed roller, said rollers being kept at a temperature below 100° C., to make a stretch ratio of not more than 1.10, subjecting the resulting filaments to 1st stage stretching between the 2nd feed roller and a 1st stretch roller to make a stretch ratio of not less than 50% of the entire stretch ratio, and subjecting the resultant filaments to 2nd stage stretching at a temperature of 100° to 200° C. between the 1st stretch roller and a 2nd stretch roller.

7. The process according to claim 1, wherein the stretching and heat treatment is carried out by prestretching the filaments between a 1st feed roller and a 2nd feed roller, said rollers being kept at a temperature below 100° C., to make a stretch ratio of not more than 1.10, subjecting the resulting filaments to 1st stage stretching between the 2nd feed roller and a 1st stretch roller to make a stretch ratio of not less than 50% of the entire stretch ratio and subjecting the resultant filaments to further stretching in not less than two steps.

8. The process according to claim 7, wherein the further stretching is carried out by subjecting the filaments to 2nd stage stretching at a temperature of 100° to 200° C. between the 1st stretch roller and the 2nd stretch roller and subjecting the filaments to 3rd stage stretching at a temperature of 160° to 220° C. and higher than the temperature for 2nd stage stretching between the 2nd stretch roller and the 3rd stretch roller.

9. The process according to claim 1, wherein the stretching and heat treatment is carried out by prestretching the filaments between a 1st feed roller and a 2nd feed roller, said rollers being kept at a temperature below 100° C., to make a stretch ratio of not more than 1.10 and subjecting the resulting filaments to 1st stage stretching between the 2nd feed roller and a 1st stretch roller while applying pressurized steam of not less than 200° C. to the filaments so as to fix the first stage stretching point around the ejecting head for the steam.

10. The process according to claim 1, wherein the stretching and heat treatment step is carried out by subjecting the filaments to stretching in two steps and subjecting the filaments to further stretching, and the further stretching is effected while applying pressurized steam of not less than 200° C. to the filaments between the 2nd stage stretch roller and the 3rd stage stretch roller so as to fix the 3rd stage stretching point around the ejecting head for the steam and then at a temperature of 185° to 220° C. between the 3rd stage stretch roller and the 4th stage stretch roller.

11. The process according to claim 1, wherein the stretching and heat treatment is carried out by pre-stretching the filaments between a 1st feed roller and a 2nd feed roller, said rollers being kept at a temperature below 100° C., to make a stretch ratio of not more than 1.10, subjecting the resulting filaments to first stage stretching between the 2nd feed roller and a 1st stretching roller to make a stretch ratio of not less than 50% of the entire stretch ratio, subjecting the resultant filaments to second stage stretching between the 1st stretching roller and a 2nd stretching roller while applying pressurized steam of not lower than 200° C. thereto so as to fix the 2nd stage stretching point around the ejecting head for the steam and subjecting the thus obtained filaments to third stage stretching between the 2nd stretching roller and a 3rd stretching roller.

12. The process according to claim 1, wherein the entire stretch ratio is not less than 4.5.

13. The process according to claim 1, further comprising the step of providing the relative viscosity of the starting polyamide to not less than 4.0.

* * * * *